US008726648B2

(12) United States Patent
Sato et al.

(10) Patent No.: US 8,726,648 B2
(45) Date of Patent: May 20, 2014

(54) HYDRAULIC DRIVE DEVICE FOR CONSTRUCTION MACHINE

(75) Inventors: Kensuke Sato, Tsuchiura (JP); Hiroyuki Azuma, Tsuchiura (JP); Tsuyoshi Nakamura, Tsuchiura (JP); Yasuo Okano, Tsuchiura (JP); Kouji Ishikawa, Tsuchiura (JP); Mitsuhiko Kanehama, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 664 days.

(21) Appl. No.: 13/009,302

(22) Filed: Jan. 19, 2011

(65) Prior Publication Data

US 2011/0192156 A1 Aug. 11, 2011

(30) Foreign Application Priority Data

Feb. 5, 2010 (JP) ..... 2010-024448

(51) Int. Cl.
*F16D 31/02* (2006.01)

(52) U.S. Cl.
USPC ..... 60/431; 60/450; 60/452

(58) Field of Classification Search
CPC ..... F16H 61/46
USPC ..... 60/431, 445, 450, 451, 452
See application file for complete search history.

(56) References Cited

U.S. PATENT DOCUMENTS 4,191,270 A * 3/1980 Monteith ..... 180/53.4
5,295,790 A * 3/1994 Bossart et al. ..... 417/43

FOREIGN PATENT DOCUMENTS

JP 3073380 B2 8/2000
JP 3811169 B2 8/2006

* cited by examiner

*Primary Examiner* — Edward Look
*Assistant Examiner* — Daniel Collins
(74) *Attorney, Agent, or Firm* — Crowell & Moring LLP

(57) ABSTRACT

A hydraulic drive device for a construction machine includes an engine stopping unit and a discharge rate control unit. The engine stopping unit stops the engine when a predetermined state of the construction machine has continued for a predetermined period of time. The discharge rate control unit controls a discharge rate control pressure being input to the regulator, when an exhaust emission control device performs regeneration control, or performs warm-up control, and the gate lock lever is in the open position.

2 Claims, 7 Drawing Sheets

HYDRAULIC DRIVE DEVICE FOR CONSTRUCTION MACHINE

CROSS-REFERENCE TO RELATED APPLICATION

This application claims priority to Japanese Patent Application No. 2010-024448, filed Feb. 5, 2010, the entire disclosure of which is incorporated by reference herein.

BACKGROUND OF THE INVENTION (1) Field of the Invention

This invention relates to a hydraulic drive device for a construction machine which stops an engine when a predetermined state of the construction machine has continued for a predetermined period of time.

(2) Description of the Related Art

As a hydraulic drive device of this type, a hydraulic drive device has been devised which includes a gate lock lever (gate bar) provided near the side of the operator's seat of the construction machine, and an engine stopping unit that stops the engine in accordance with the position of this gate lock lever. The gate lock lever is operated to switch between a close position in which the gate lock lever projects obliquely toward the boarding entrance to close the boarding entrance, and an open position in which the gate lock lever retracts toward the side of the operator's seat to open the boarding entrance. This gate lock lever is provided with a position detecting unit that outputs a gate close signal upon detecting that the gate lock lever is in the close position, and outputs a gate open signal upon detecting that the gate lock lever is in the open position. The engine stopping unit is set to stop the engine when a predetermined period of time has elapsed in the state in which the gate open signal is outputted from the position detecting unit, in other words, in the state in which the gate lock lever is in the open position. The gate lock lever is operated to switch from the close position to the open position when the operator of the construction machine leaves the cabin. That is, the engine stops when a predetermined period of time has elapsed after the operator of the construction machine leaves the cabin without stopping the engine. This can contribute to reducing wasted fuel consumption, and also reducing environmental destruction such as global warming due to exhaust gas (see Japanese Patent No. 3811169).

Also, as another hydraulic drive device according to the related art different from the hydraulic drive device described above, there is a hydraulic drive device which includes an exhaust emission control device. This exhaust emission control device has an exhaust filter provided to the exhaust pipe of the engine, and captures particulate matter contained in exhaust gas by this exhaust filter. When this exhaust filter becomes clogged with particulate matter, the hydraulic drive device performs regeneration control for removing the particulate matter from the exhaust filter by burning the particulate matter, in other words, for regenerating the function of the exhaust filter. This regeneration control is, for example, a control for raising the discharge pressure and discharge flow rate of a variable displacement hydraulic pump driven by the engine, thereby increasing the load applied to the engine to raise the temperature of exhaust gas to a sufficient temperature for the particulate matter to burn (see Japanese Patent No. 3073380).

SUMMARY OF THE INVENTION

As a type of the above-described hydraulic drive device including an exhaust emission control device, there is a hydraulic drive device which performs regeneration control in the state in which the gate lock lever is operated into the open position. In the case of this hydraulic drive device, if the engine is stopped at the time when a predetermined period of time has elapsed since the gate lock lever is held in the open position, there is a possibility that the regeneration control of the exhaust filter is not sufficiently performed, with the result that the function of the exhaust filter is not sufficiently regenerated.

Also, in the state in which the gate lock lever is operated into the open position, a warm-up operation is sometimes performed to warm hydraulic oil by circulating the hydraulic oil in the hydraulic circuit. At the time of this warm-up operation, the variable displacement hydraulic pump is driven by the engine in the state in which the discharge rate of the variable displacement hydraulic pump is controlled to be higher than the lower limit for use in the construction machine. This warm-up operation is also finished without sufficient warm-up, if the engine is stopped at the time when a predetermined period of time has elapsed since the gate lock lever is held in the open position.

The present invention has been made in view of the above circumstances and provides a hydraulic drive device for a construction machine which can reliably judge whether or not the state of the construction machine is appropriate for automatically stopping the engine.

To this end, the present invention is configured as described below.

[1] According to an embodiment of the present invention, there is provided a hydraulic drive device for a construction machine, including a variable displacement hydraulic pump, a discharge rate control unit that controls a discharge rate of the variable displacement hydraulic pump by a control signal, an engine that drives the variable displacement hydraulic pump, an engine stopping unit that stops the engine when a predetermined state of the construction machine has continued for a predetermined period of time, and a signal detecting unit that detects the control signal, in which the engine stopping unit has a control signal judging unit that judges whether or not a signal value of the control signal detected by the signal detecting unit is lower than a predetermined signal value, as a judgment of whether or not the predetermined state is present, and the engine stopping unit stops the engine when a judgment result that the signal value of the control signal is lower than the predetermined signal value is obtained by the control signal judging unit.

In the hydraulic drive device according to "[1]" above, the engine stopping unit stops the engine when a judgment result that the signal value of the control signal from the discharge rate control unit is lower than the predetermined signal value is obtained by the control signal judging unit. That is, whether or not the state of the construction machine is appropriate for stopping the engine can be reliably judged by the control signal judging unit.

[2] According to an embodiment of the present invention, in the hydraulic drive device for a construction machine according to "[1]" the predetermined signal value is a signal value for controlling the discharge rate of the variable displacement hydraulic pump to a lower limit for use in the construction machine. It should be noted that as for the discharge rate of the variable displacement hydraulic pump, the lower limit for use in the construction machine is one of a discharge rate that is set so as to substantially coincide with the minimum discharge rate as given by the specifications (performance) of the variable displacement hydraulic pump, and a discharge rate that is set to be larger than the minimum discharge rate.

In the hydraulic drive device according to "[2]" above, the state of the discharge rate being the lower limit for use in the construction machine is a state when neither regeneration control of the exhaust filter nor a warm-up operation for warming hydraulic oil is performed, in other words, a state appropriate for stopping the engine.

[3] According to an embodiment of the present invention, there is provided a hydraulic drive device for a construction machine, including a variable displacement hydraulic pump, an engine that drives the variable displacement hydraulic pump, an engine stopping unit that stops the engine when a predetermined state of the construction machine has continued for a predetermined period of time, and a discharge rate detecting unit that detects a discharge rate of the variable displacement hydraulic pump, in which the engine stopping unit has a discharge rate judging unit that judges whether or not the discharge rate detected by the discharge rate detecting unit is equal to or lower than a predetermined discharge rate, as a judgment of whether or not the predetermined state is present, and the engine stopping unit stops the engine when a judgment result that the discharge rate is equal to or lower than the predetermined discharge rate is obtained by the discharge rate detecting unit.

In the hydraulic drive device according to "[3]" above, the engine stopping unit stops the engine when a judgment result that the discharge rate is equal to or lower than the predetermined discharge rate is obtained by the discharge rate detecting unit. That is, whether or not the state of the construction machine is appropriate for stopping the engine can be reliably judged by the discharge rate judging unit.

[4] According to an embodiment of the present invention, in the hydraulic drive device for a construction machine according to "[3]", the predetermined discharge rate is a discharge rate lower than a lower limit for use in the construction machine.

As described above, a hydraulic drive device for a construction machine according to an embodiment of the present invention can reliably judge whether or not the state of the construction machine is appropriate for stopping the engine. Thus, regeneration control of the exhaust filter, and a warm-up operation can be performed appropriately.

BRIEF DESCRIPTION OF THE DRAWINGS

Embodiments of the present invention will be described in detail based on the following drawings, wherein.

DETAILED DESCRIPTION OF THE INVENTION

A hydraulic drive device for a construction machine according to each of first and second embodiments of the present invention will be described.

First Embodiment

A hydraulic drive device for a construction machine according to a first embodiment will be described with reference to FIGS. 1 to 5.

Figure 1:
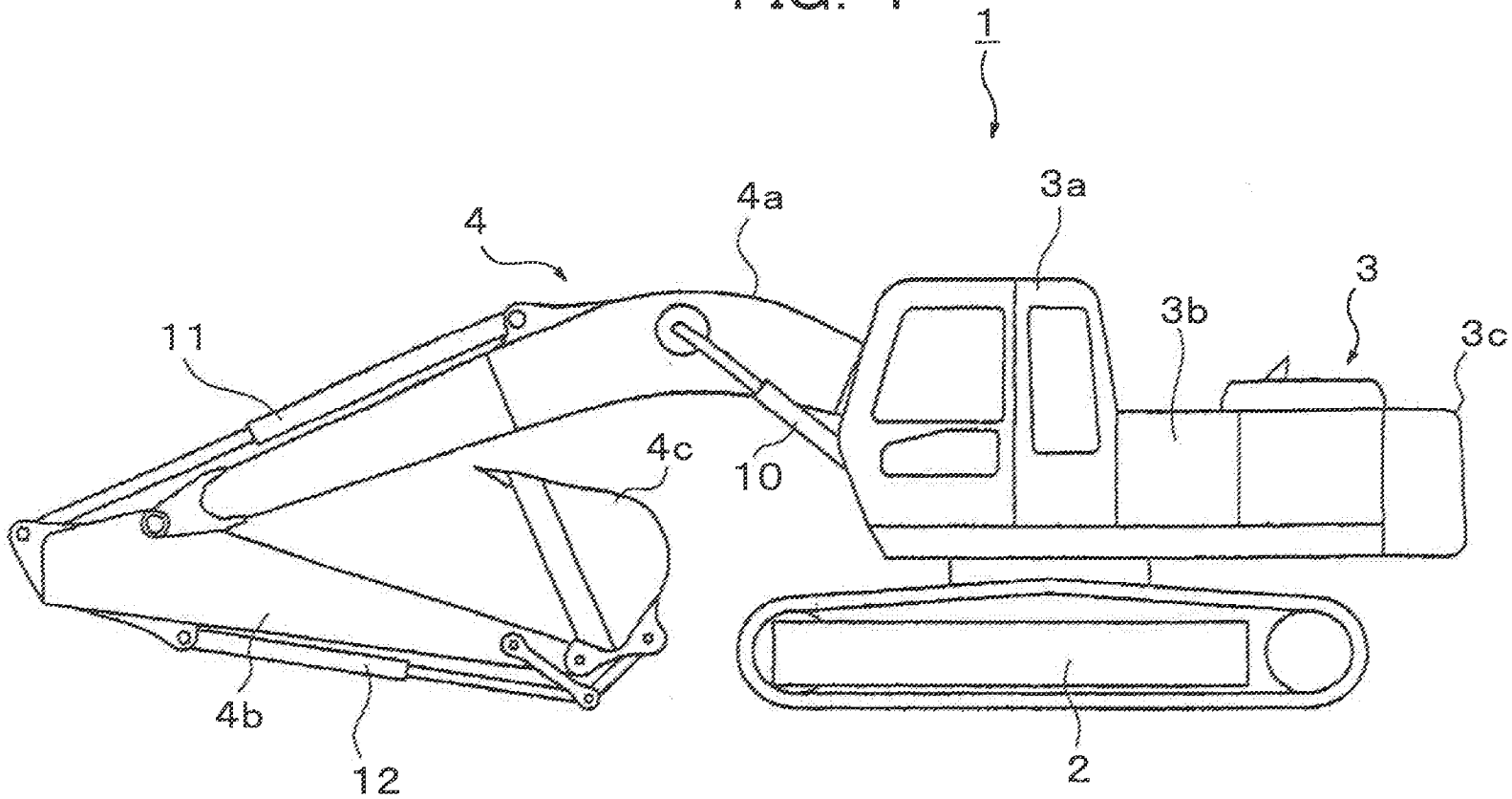
FIG. 1 is a left side view of a hydraulic excavator as a construction machine to which a hydraulic drive device according to a first embodiment of the present invention is applied.

As shown in FIG. 1, a hydraulic excavator 1 has a travelling body 2 that travels by driving crawlers, a swing body 3 swingably coupled to the travelling body 2, and a front attachment 4 provided at substantially the center of the front of the swing body 3. The swing body 3 has a cabin 3*a* provided to the left of the front attachment 4, a counterweight 3*c* that forms the rear end of the swing body 3, and a machine room 3*b* formed so as to extend between the rear of the cabin 3*a* and the counterweight 3*c*. The front attachment 4 is of a backhoe type, and has a boom 4*a* coupled to the front of the swing body 3 so as to be vertically rotatable, an arm 4*b* rotatably coupled to the boom 4*a*, and a bucket 4*c* rotatably coupled to the arm 4*b*.

Figure 2:
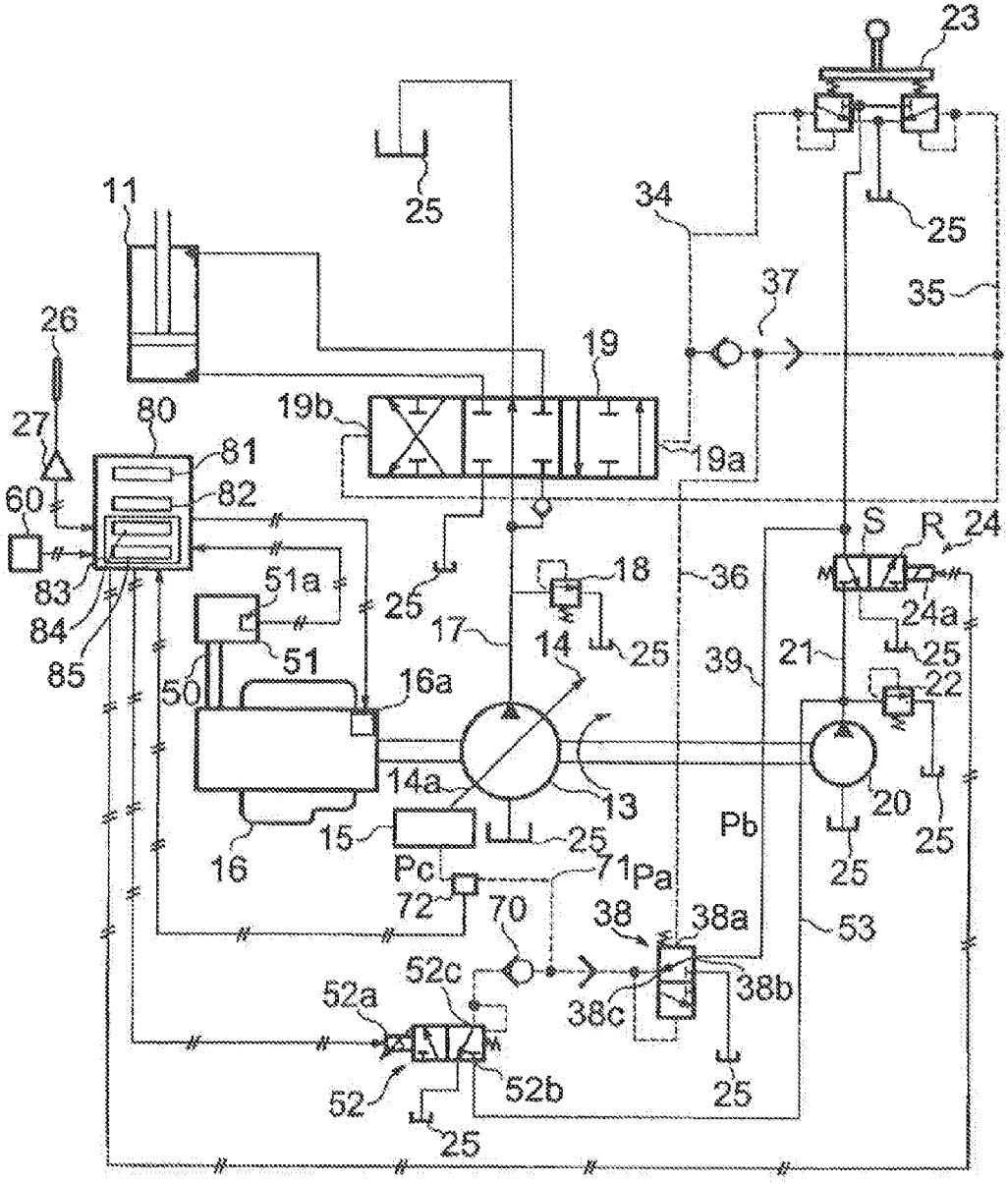
FIG. 2 is a hydraulic circuit diagram of the hydraulic drive device according to the first embodiment of the present invention.

The hydraulic, excavator 1 includes plural hydraulic actuators for driving each of the travelling body 2, the swing body 3, and the front attachment 4. Those plural hydraulic actuators are, specifically, a left travel motor (not shown) and a right travel motor (not shown) that drive the left and right crawlers of the travelling body 2, respectively, a swing motor (not shown) that drives the swing body 3, a boom cylinder 10 that drives the boom 4*a*, an arm cylinder 11 that drives the arm 4*b*, and a bucket cylinder 12 that drives the bucket 4*c*. Discharge oil from the main pump 13 formed by a variable displacement hydraulic pump shown in FIG. 2 is supplied to each of these hydraulic actuators. The main pump 13 is driven by an engine 16.

The main pump 13 has a variable mechanism portion 14 that makes discharge rate variable by tilting of a swash plate 14*a*, and a regulator 15 that drives the variable mechanism portion 14. The regulator 15 operates when given a control signal in the form of hydraulic pressure, in other words, control pressure Pc, and drives the variable mechanism portion 14. A relief valve 18 is connected to a main line 17 that guides pressure oil from the main pump 13 to an arm control valve 19 and the like. The upper limit on the discharge pressure of the main pump 13 is regulated by the relief valve 18.

Between the main pump 13 and the left travel motor, between the main pump 13 and the right travel motor, between the main pump 13 and the swing motor, between the main pump 13 and the boom cylinder 10, between the main pump 13 and the arm cylinder 11, and between the main pump 13 and the bucket cylinder 12, hydraulic pilot control valves that control the operations of those respective hydraulic actuators are provided. The control valves each control the direction and rate of flow of pressure oil supplied to each of the hydraulic actuators such as the left travel motor, the right travel motor, the swing motor, the boom cylinder 10, the arm cylinder 11, and the bucket cylinder 12. In FIG. 2, for the sake of simplicity, only the arm control valve 19 is depicted among those control valves, and also, the arm cylinder 11 corresponding to the arm control valve 19 is depicted as representing the left travel motor, the right travel motor, the boom cylinder 10, the arm cylinder 11, and the bucket cylinder 12.

The engine 16 also drives a pilot pump 20 formed by a fixed displacement hydraulic pump, in addition to the main pump 13. Although not shown, a left-travel operating lever device, a right-travel operating lever device, a swing/arm operating lever device, and a boom/bucket operating lever device are provided inside the cabin 3*a*. These operating lever devices are each supplied with the discharge pressure of the pilot pump 20 via a supply line 21, and generate a pilot pressure applied to each of the control valves mentioned above. A relief valve 22 is connected to the supply line 21. The upper limit on the discharge pressure of the pilot pump 20 is regulated by the relief valve 22. In FIG. 2, for the sake of simplicity, only an operating lever device 23 for operating the arm control valve 19 mentioned above is depicted among those operating lever devices.

The supply line 21 is provided with a gate lock valve 24 that can shut off supply of pressure oil from the pilot pump 20 to the operating lever device 23. The gate lock valve 24 is an solenoid valve of a spring return type. The normal position of the gate lock valve 24 is set to a shut-off position S, and the actuated position of the gate lock valve 24 is set to a communicating position R. The communicating position R is a valve position for allowing communication between the pilot pump 20 and the operating lever device 23, and the shut-off position S is a valve position for shutting off communication between the pilot pump 20 and the operating lever 23 while allowing communication between the operating lever device 23 and a hydraulic oil tank 25.

A gate lock lever 26 is provided near the side of a operator's seat in the cabin 3*a*. The gate lock lever 26 is operated to switch between a close position in which the gate lock lever 26 projects obliquely toward the boarding entrance to the cabin 3*a* to close the boarding entrance, and an open position in which the gate lock lever 26 retracts toward the side of the operator's seat to open the boarding entrance. The gate lock lever 26 is provided with a lever switch 27 that outputs a gate close signal upon detecting that the gate lock lever 26 is in the close position, and outputs a gate open signal upon detecting that the gate lock lever 26 is in the open position. These gate close signal and gate open signal are outputted to a controller 80.

The controller 80 includes a CPU (Central Processing Unit), a ROM (Read Only Memory) storing a control program and data, RAM (Random Access Memory) used as the working area of the CPU, and the like. The controller 80 performs processing related to control of the hydraulic excavator by reading the control program and data stored in the ROM. With input of a gate close signal from the lever switch 27 as a trigger, the controller 80 supplies current to a solenoid 24*a* of the gate lock, valve 24 to switch the valve position from the shut-off position S to the communicating position R, and when a gate open signal from the lever switch 27 is inputted, the controller 80 stops the supply of current to the solenoid 24*a* to return the valve position of the gate lock valve 24 from the communicating position R to the shut-off position S.

Pilot lines 34 and 35 extend from the operating lever device 23 to hydraulic pilot portions 19*a* and 19*b* of the arm control valve 19, respectively. Each of a pair of inlets of a high pressure preference type shuttle valve 37 is connected to each of the pilot lines 34 and 35. The high pressure preference type shuttle valve 37 is a valve that selects the higher one of the pressure in the pilot, line 34 and the pressure in the pilot line 35, as a pilot pressure for operating a pressure control valve 38. The pressure control valve 38 has a hydraulic pilot portion 38*a* that admits the pilot pressure from the high pressure preference type shuttle valve 37 through a pilot line 36, an inlet 38*b* for admitting the discharge pressure of the pilot pump 20 through a first branch line 39 branched off from the supply line 21, and an outlet 38*c* for discharging control pressure Pc to be applied to the regulator 15. As described above, control pressure Pc is a control signal for controlling the regulator 15. The valve position of the pressure control valve 38 varies with pilot pressure Pa applied to the hydraulic pilot portion 38*a*, and thus control pressure Pc is generated from the discharge pressure of the pilot pump 20. The pressure control valve 38 is a discharge rate control unit that controls the discharge rate of the main pump 13 by a control signal.

Figure 3:
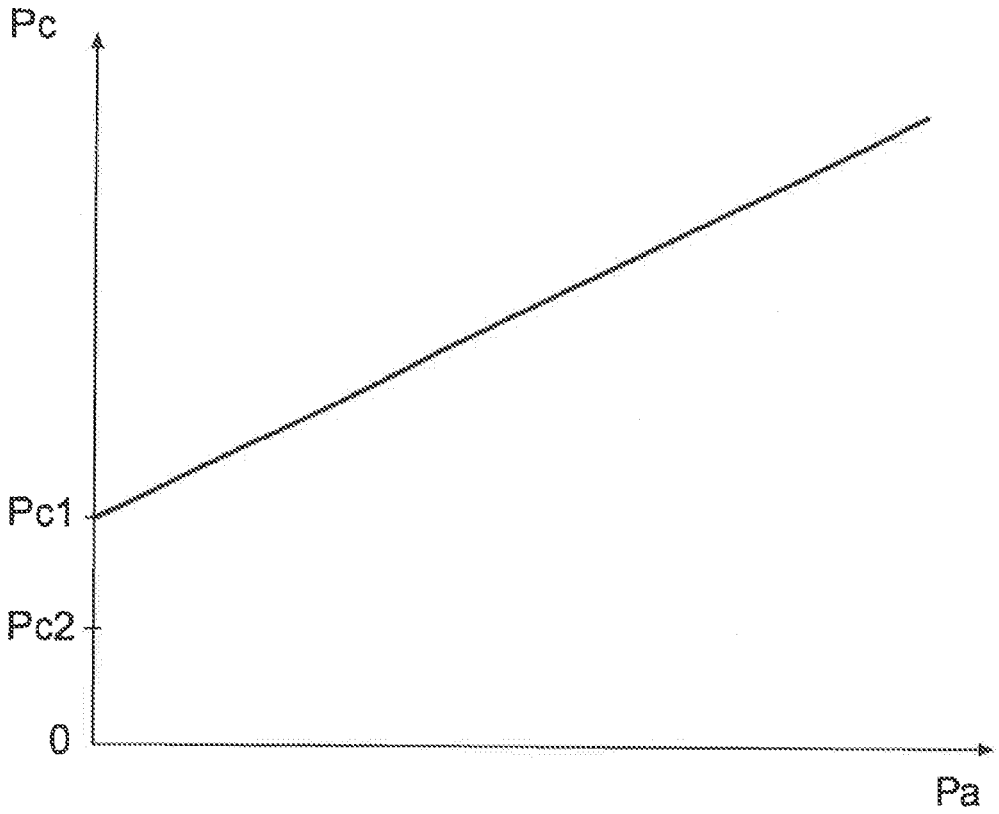
FIG. 3 is a diagram showing the relationship between a pilot pressure generated by an operating lever device shown in FIG. 2 and a control pressure (control signal) generated by a pressure control valve.
Figure 4:
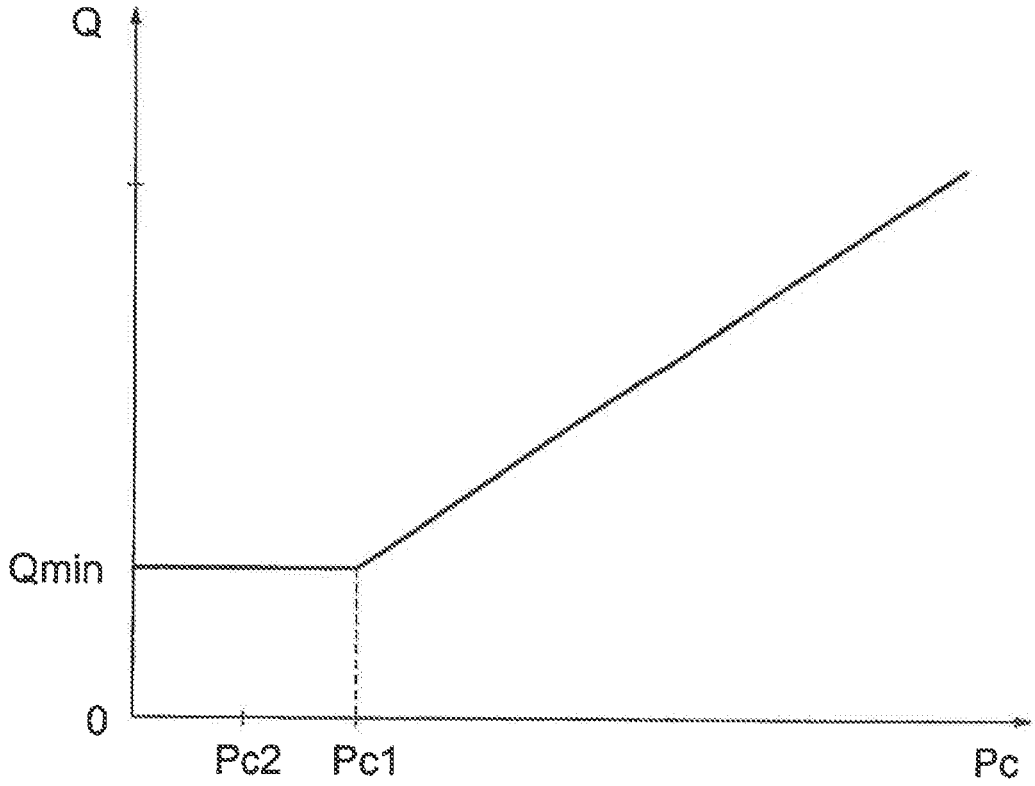
FIG. 4 is a diagram showing the characteristic of the discharge rate of a main pump (variable displacement hydraulic pump) shown in FIG. 2, with respect to the control pressure (control signal) shown in FIG. 3.

As shown in FIG. 3, in the state when the valve position of the gate lock valve 24 is the communicating position R, pilot pressure Pa applied to the hydraulic pilot portion 38*a* of the pressure control valve 38 rises with increase in the amount of lever operation of the operating lever device 23. Control pressure Pc rises from control pressure Pc1 in proportion to this rise in pilot pressure Pa. When the valve position of the gate lock valve 24 is the shut-off position S, the first branch line 39 is in communication with the hydraulic oil tank 25 via the supply line 21 and the gate lock valve 24, and generation of pilot pressure Pa by the operating lever device 23 is not performed. Thus, control pressure Pc generated by the pressure control valve 38 is equal to tank pressure Pt (substantially zero [Pa]). As shown in FIG. 4, the relationship between the discharge rate Q of the main pump 13 and control pressure Pc is set such that discharge rate Q is Qmin when control pressure Pc is in the range of "$0 \leq Pc \leq Pc1$", and discharge rate Q is proportional to control pressure Pc when control pressure Pc is in the range of "$Pc1 < Pc$". Control pressure Pc1 is the minimum control pressure generated by the pressure control valve 38 in the state when the valve position of the gate lock valve 24 is the communicating position R. Also, control pressure Pc1 is a pressure for regulating the discharge rate Q of the main pump 13 to the lower limit for use in the hydraulic excavator 1, for example, minimum discharge rate Qmin. It should be noted that the lower limit on discharge rate Q for use in the hydraulic excavator 1 is not limited to minimum discharge rate Qmin as given by the specifications (performance) of the main pump 13 but may be larger than the minimum discharge rate.

Returning to FIG. 2, an exhaust pipe 50 of the engine 16 is provided with an exhaust emission control device 51. The exhaust emission control device 51 is provided with an exhaust filter (not shown) that captures particulate matter in the exhaust gas passing through the exhaust pipe 50, and a differential pressure sensor 51*a* that detects the differential pressure between the exhaust gas pressure on the upstream side of this exhaust filter and the exhaust gas pressure on the downstream side and converts the detected differential pressure into a differential pressure detection signal (electrical signal). As clogging of the exhaust filter of the exhaust emission control device 51 increases, the channel resistance to the exhaust gas increases, and the exhaust gas pressure on the upstream side becomes higher than that on the downstream side. The differential pressure sensor 51*a* detects the differential pressure due to the increase in channel resistance, and outputs the resulting differential pressure detection signal to the controller 80 mentioned above.

The controller 80 has a regeneration control unit 81. The regeneration control unit 81 is set by the control program and data stored in the ROM. The regeneration control unit 81 judges whether or not a differential pressure detection signal indicates a differential pressure equal to or higher than a predetermined differential pressure, and also whether or not a gate open signal from the lever switch 27 has been inputted. The regeneration control unit 81 performs regeneration control of the exhaust filter when the regeneration control unit 81 obtains a judgment result that the differential detection signal indicates a differential pressure equal to or higher than a predetermined differential pressure, and that a gate open signal from the lever switch 27 has been inputted. The predetermined differential pressure is set as the differential pressure in the case when the exhaust filter has become clogged to such an extent that it is necessary to regenerate the function of the exhaust filter. A proportional solenoid valve 52 is controlled in the regeneration control. The proportional solenoid valve 52 is a pressure control valve of a proportional electromagnetic type which is actuated when current is supplied to a solenoid 52*a*. The proportional solenoid valve 52 admits the discharge pressure of the pilot pump 20 from an inlet 52*b* through a second branch line 53. When actuated, the proportional solenoid valve 52 generates control pressure Pc from the discharge pressure of the pilot pump 20, and discharges the control pressure Pc from an outlet 52*c*. The control pressure Pc at this time is set to control pressure Pc3 (Pc3>Pc1) of a pressure value at which the discharge rate of the main pump 13 becomes a discharge rate for regeneration. This discharge rate for regeneration is set for the purpose of applying to the engine 16 a load for raising the temperature of exhaust gas to a sufficient temperature for particulate matter to burn. It should be noted that a variable throttle that can be electrically operated by the controller 80 may be added to the main line 17 so that in the regeneration control, not only the discharge rate of the main pump 13 but also the discharge pressure of the main pump 13 can be raised, in other words, so that a load can be applied to the engine 16 by both the discharge rate and the discharge pressure.

A warm-up switch 60 that is operated to output a warm-up command signal (electrical signal) is provided inside the cabin 3*a*. The controller 80 includes a warm-up control unit 82. The warm-up control unit 82 is set by the control program and data stored in the ROM. The warm-up control unit 82 performs warm-up control when a warm-up command signal from the warm-up switch 60 is inputted. In this warm-up control, the proportional solenoid valve 52 is actuated by supplying current to the solenoid 52*a*. The control pressure Pc at this time is set to control pressure Pc4 (Pc4>Pc1) of a pressure value at which the discharge rate of the main pump 13 becomes a discharge rate for warm-up operation. The discharge rate for warm-up operation is set for the purpose of warming hydraulic oil, in other words, performing warm-up operation, by circulating the hydraulic oil within the hydraulic circuit.

The outlet 52*c* of the proportional solenoid valve 52 and the outlet 38*c* of the pressure control valve 38 mentioned above are each connected to each of a pair of inlets of a high pressure preference type shuttle valve 70. The pressure on the high pressure side selected by the high pressure preference type shuttle valve 70 is applied to the regulator 15 as control pressure Pc. The second branch line 53 is located on the upstream side of the gate lock valve 24 in the direction of the flow of pressure oil caused by the pilot pump 20, whereas the first branch line 39 mentioned above is located downstream of the gate lock valve 24. Therefore, the state in which the valve position of the gate lock valve 24 is controlled to the shut-off position S is a state in which the regulator 15 of the main pump 13 can be controlled only by control pressure Pc generated by the proportional solenoid valve 52 out of the proportional solenoid valve 52 and the pressure control valve 38.

A control line 71 that guides control pressure Pc from the high pressure preference type shuttle valve 70 to the regulator 15 is provided with a pressure sensor 72, which serves as a signal detecting unit that detects control pressure Pc (control signal) applied to the regulator 15. The control pressure Pc detected by the pressure sensor 72 is converted into a pressure detection signal formed by an electrical signal and outputted to the controller 80.

In the first embodiment, in particular, the controller 80 includes an engine stopping unit 83 that stops the engine 16 when the hydraulic excavator 1 is in a predetermined state. An engine controller 16*a* that includes a CPU, a ROM, a PJM, and the like and controls a fuel injector is attached to the engine 16. The engine stopping unit 83 stops the engine 16 by performing an engine stopping process that commands the engine controller 16*a* to stop the fuel injector. The engine stopping unit 83 is set by the control program and data stored in the ROM, and has a control signal judging unit 84 and a timer 85, each serving as a unit that judges whether or not the hydraulic excavator 1 is in a predetermined state.

The control signal judging unit 84 judges whether or not the pressure value (signal value) of control pressure Pc (control signal) based on the pressure detection signal is lower than a predetermined pressure value. The predetermined pressure value is a pressure value for controlling the discharge rate of the main pump 13 to the lower limit (minimum discharge rate Qmin in this embodiment) for use in the hydraulic excavator 1, in other words, the pressure value of control pressure Pc1 generated by the pressure control valve 38 in the state when the valve position of the gate lock valve 24 is the communicating position R and when manipulated variable of the operating lever device 23 is zero. The control signal judging unit 84 stores threshold pressure Pc2 smaller than the control pressure Pc1 and larger than a tank pressure in advance, and is set to judge whether or not control pressure Pc based on a pressure detection signal is lower than the threshold pressure Pc2.

The timer 85 judges, on the basis of clock frequency, whether or not predetermined period of time T, for example, three minutes has elapsed since a judgment result that control pressure Pc based on a pressure detection signal is lower than the threshold pressure Pc2 is obtained.

The hydraulic drive device according to the first embodiment operates as in "(1)", "(2)", and "(3)" below, in the state in which the gate lock lever 26 is operated into the open position.

(1) Operation when Performing Regeneration Control

When the gate lock lever 26 is operated from the close position to the open position, the valve position of the gate lock valve 24 switches from the communicating position R to the shut-off position S. At this time, the lever switch 27 outputs a gate open signal, and this gate open signal is inputted to the controller 80. On the other hand, a differential pressure detection signal from the differential pressure sensor 51*a* of the exhaust emission control device 51 is also inputted to the controller 80. Then, the regeneration control unit 81 of the controller 80 judges whether or not, in the state in which the gate open signal has been inputted, the differential pressure detection signal indicates a predetermined differential pressure or more. Suppose that at the present time, the regeneration control unit 81 has judged that the differential pressure detection signal indicates a predetermined differential pressure or more. That is, suppose that clogging of the exhaust filter that necessitates regeneration of the function of the exhaust filter has been detected. In this case, the regeneration control unit 81 performs regeneration control. That is, the proportional solenoid valve 52 is actuated by supplying current to the solenoid 52*a*, and thus the proportional solenoid valve 52 generates control pressure Pc3 from the discharge pressure of the pilot pump 20 and discharges this control pressure Pc3 from the outlet 52*c*. Currently, the valve position of the gate lock valve 24 is the shut-off position 5, and thus control pressure Pc generated by the pressure control valve 38 is tank pressure Pt (substantially zero [Pa]). Therefore, control pressure Pc3 generated by the proportional solenoid valve 52 is applied to the regulator 15 of the main pump 13 through the high pressure preference type shuttle valve 70 and the control line 71, and the discharge flow rate of the main pump 13 rises from minimum discharge rate Qmin to the discharge rate for regeneration. As a result, the load of the engine 16 rises, the temperature of exhaust gas rises to a sufficient temperature for particulate matter to burn, and clogging of the exhaust filter is removed, in other words, the function of the exhaust filter is regenerated.

Figure 5:
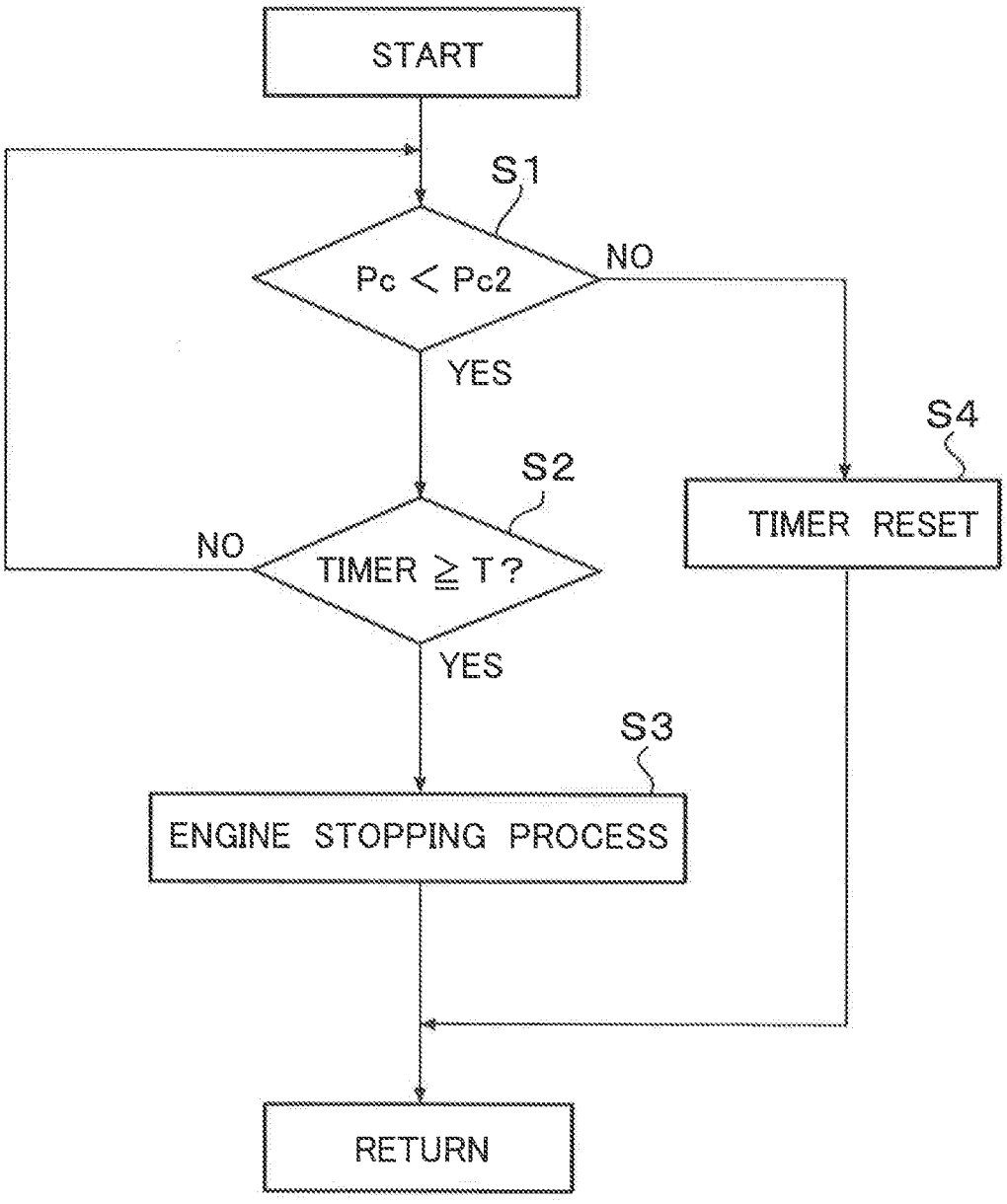
FIG. 5 is a flowchart showing the flow of processing performed by a controller shown in FIG. 2.

While regeneration control is performed in this way, the pressure sensor 72 detects control pressure Pc3 applied to the regulator 15 of the main pump 13, and outputs a pressure detection signal corresponding to the detected control pressure Pc3. This pressure detection signal is inputted to the controller 80. Following this, in the controller 80, as shown in FIG. 5, the control signal judging unit 84 of the engine stopping unit 83 judges whether or not control pressure Pc3 indicated by the pressure detection signal is lower than threshold pressure Pc2 (step S1), and also starts counting by the timer 85. At the present time, the engine stopping unit 83 obtains by the control signal judging unit 84 a judgment result that control pressure Pc3 is higher than threshold pressure Pc2 (NO in step S1), and resets the timer 85 (step S4). That is, the engine stopping unit 83 judges that the current state is a state in which driving of the main pump 13 by the engine 16 is required, in other words, the hydraulic excavator 1 is in a state inappropriate for stopping the engine 16, and thus does not perform stopping of the engine 16.

(2) Operation when Performing Warm-Up Control

When the warm-up switch 60 is operated to output a warm-up command signal, this warm-up command signal is inputted to the controller 80. Following this, the warm-up control unit 82 of the controller 80 performs warm-up control. That is, the proportional solenoid valve 52 is actuated by supplying current to the solenoid 52*a*, and thus the proportional solenoid valve 52 generates control pressure Pc4 from the discharge pressure of the pilot pump 20 and discharges this control pressure Pc4 from the outlet 52*c*. Currently, the valve position of the gate lock valve 24 is the shut-off position S, and therefore control pressure Pc generated by the pressure control valve 38 is tank pressure it (substantially zero [Pa]). Thus, control pressure Pc4 generated by the proportional solenoid valve 52 is applied to the regulator 15 of the main pump 13 through the high pressure preference type shuttle valve 70 and the control line 71, and the discharge flow rate of the main pump 13 rises from minimum discharge rate Qmin to the discharge rate for warm-up operation. As a result, hydraulic oil circulates within the hydraulic circuit and warms up.

While warm-up control is performed in this way, the pressure sensor 72 detects control pressure Pc4 applied to the regulator 15 of the main pump 13, and outputs a pressure detection signal corresponding to the detected control pressure Pc4. This pressure detection signal is inputted to the controller 80. Following this, in the controller 80, as shown in FIG. 5, the control signal judging unit 84 of the engine stopping unit 83 judges whether or not control pressure Pc4 indicated by the pressure detection signal is lower than threshold pressure Pc2 (step S1), and also starts counting by the timer 85. At the present time, since warm-up control is being performed, the engine stopping unit 83 obtains by the control signal judging unit 84 a judgment result that control pressure Pc4 is higher than threshold pressure Pc2 (NO in step S1), and resets the timer 85 (step S4). That is, the engine stopping unit 83 judges that the current state is a state in which driving of the main pump 13 by the engine 16 is required, in other words, the hydraulic excavator 1 is in a state inappropriate for stopping the engine 16, and thus does not perform stopping of the engine 16.

(3) Operation when not Performing Regeneration Control and Warm-Up Control

In the case when the controller 80 performs neither regeneration control nor warm-up control, control pressure Pc generated by the proportional solenoid valve 52 is the tank pressure (substantially zero [Pa]). At this time, since the valve position of the gate lock valve 24 is the shut-off position S, control pressure Pc generated by the pressure control valve 38 is also the tank pressure. That is, control pressure Pc applied to the regulator 15 of the main pump 13 through the high pressure preference type shuttle valve 70 and the control line 71 is tank pressure Pt. The pressure sensor 72 detects this tank pressure Pt, and outputs to the controller 80 a pressure detection signal corresponding to the detected tank pressure Pt. This pressure detection signal is inputted to the controller 80. Following this, in the controller 80, as shown in FIG. 5, the control signal judging unit 84 of the engine stopping unit 83 judges whether or not control pressure Pc indicated by the pressure detection signal is lower than threshold pressure Pc2 (step S1), and also starts counting by the timer 85. Then, at the present time, since control pressure Pc is tank pressure Pt, the engine stopping unit 83 obtains by the control signal judging unit 84*a* a judgment result that control pressure Pc is lower than threshold pressure Pc2 (YES in step S1). Then, until predetermined period of time T (three minutes) is counted by the timer 85, the judgment of whether or not control pressure Pc is lower than threshold pressure Pc2 is repeated (repetition of NO in step S2 and then YES in step S1), and if the judgment result that control pressure Pc is lower than threshold pressure Pc2 is continuously obtained (YES in step S2), the engine stopping unit 83 performs the engine stopping process, and commands the engine controller 16*a* to stop the fuel injector (step S3). That is, the engine stopping unit 83 judges that the current state is a state in which driving of the main pump 13 by the engine 16 is not required, in other words, the hydraulic excavator 1 is in a state appropriate for stopping the engine 16, and thus stops the engine 16.

Stopping the engine 16 in this way contributes to reducing wasted fuel consumption, and also reducing environmental destruction such as global warming due to exhaust gas in the case when, for example, the operator leaves the cabin 3*a* without stopping the engine 16 with the intention of coming back soon, and thereafter does not come back to the cabin 3*a* even after predetermined period of time T (three minutes) has elapsed.

It should be noted that in the case when control pressure Pc rises above threshold pressure Pc2, such as when warm-up control is started, and when the hydraulic excavator 1 is operated again, before predetermined period of time T (three minutes) is counted by the timer 85, a routine process of "NO in step S2, then NO in step S1, and then step S4" is performed, and the engine 16 is not stopped.

The hydraulic drive device according to the first embodiment provides the following advantageous effects.

In the hydraulic drive device according to the first embodiment, when stopping the engine 16, the engine stopping unit 83 judges, by the control signal judging unit 84, whether or not control pressure Pc for the regulator 15 is lower than threshold pressure Pc2, in other words, whether or not control pressure Pc is lower than control pressure Pc1 for controlling the discharge rate of the main pump 13 to the lower limit (minimum discharge rate Qmin) for use in the hydraulic excavator 1. The state when the discharge rate of the main pump 13 is lower than its lower limit for use in the hydraulic excavator 1 is a state when neither regeneration control of the exhaust filter nor a warm-up operation for warming hydraulic oil is performed, in other words, a state appropriate for stopping the engine 16. That is, the hydraulic drive device according to the first embodiment can reliably judge by the control signal judging unit 84 whether or not the state of the hydraulic excavator 1 is appropriate for stopping the engine 16.

It should be noted that the hydraulic drive device according to the first embodiment described above includes the main pump 13 (variable displacement hydraulic pump). While the main pump 13 has a characteristic such that the relationship between discharge rate Q and control pressure Pc is as shown in FIG. 4, the characteristic of the variable displacement hydraulic pump according to an embodiment of the present invention is not limited to the one shown in FIG. 4 but may be the characteristic shown in FIG. 6, in other words, a characteristic such that discharge rate Q is proportional to control pressure Pc when control pressure Pc is in the range of "0<Pc". In this case, control pressure Pc1 is a pressure for regulating the lower limit on discharge rate Q of the main pump 13 for use in the hydraulic excavator 1 to, for example, discharge rate Q1 higher than minimum discharge rate Qmin.

Second Embodiment

A hydraulic drive device according to a second embodiment will be described with reference to FIGS. 6 and 7.

Figure 6:
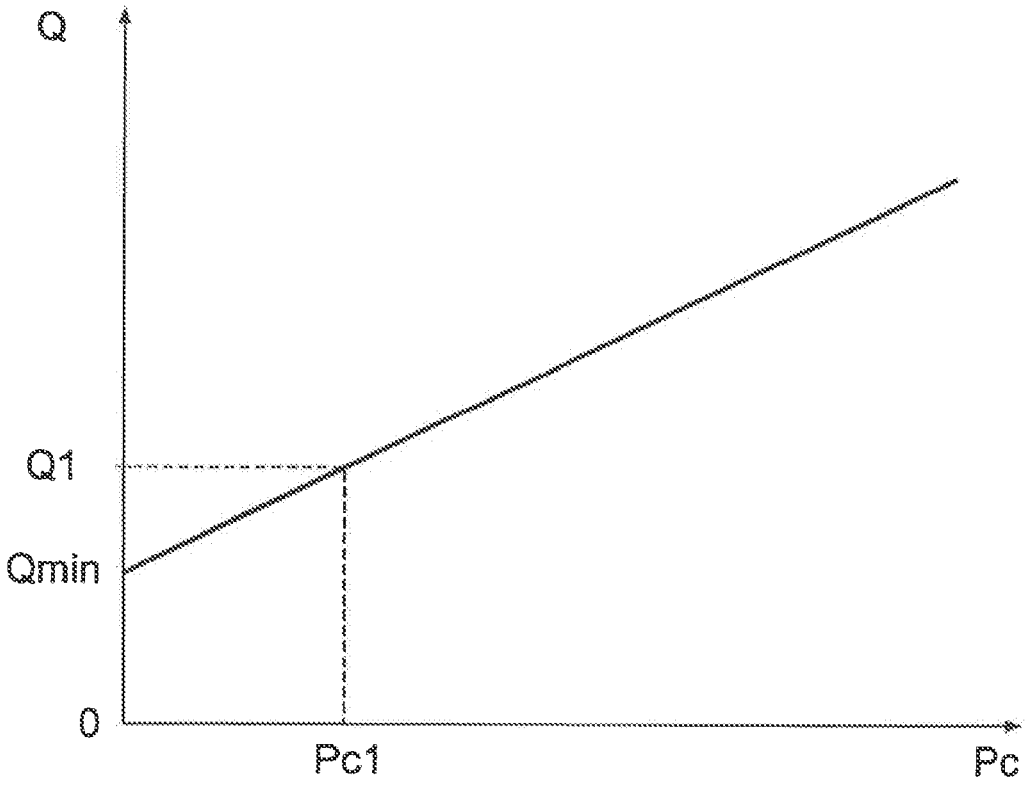
FIG. 6 is a diagram showing the characteristic of the discharge rate of the variable displacement hydraulic pump with respect to the control pressure, which is different from the characteristic shown in FIG. 2.
Figure 7:
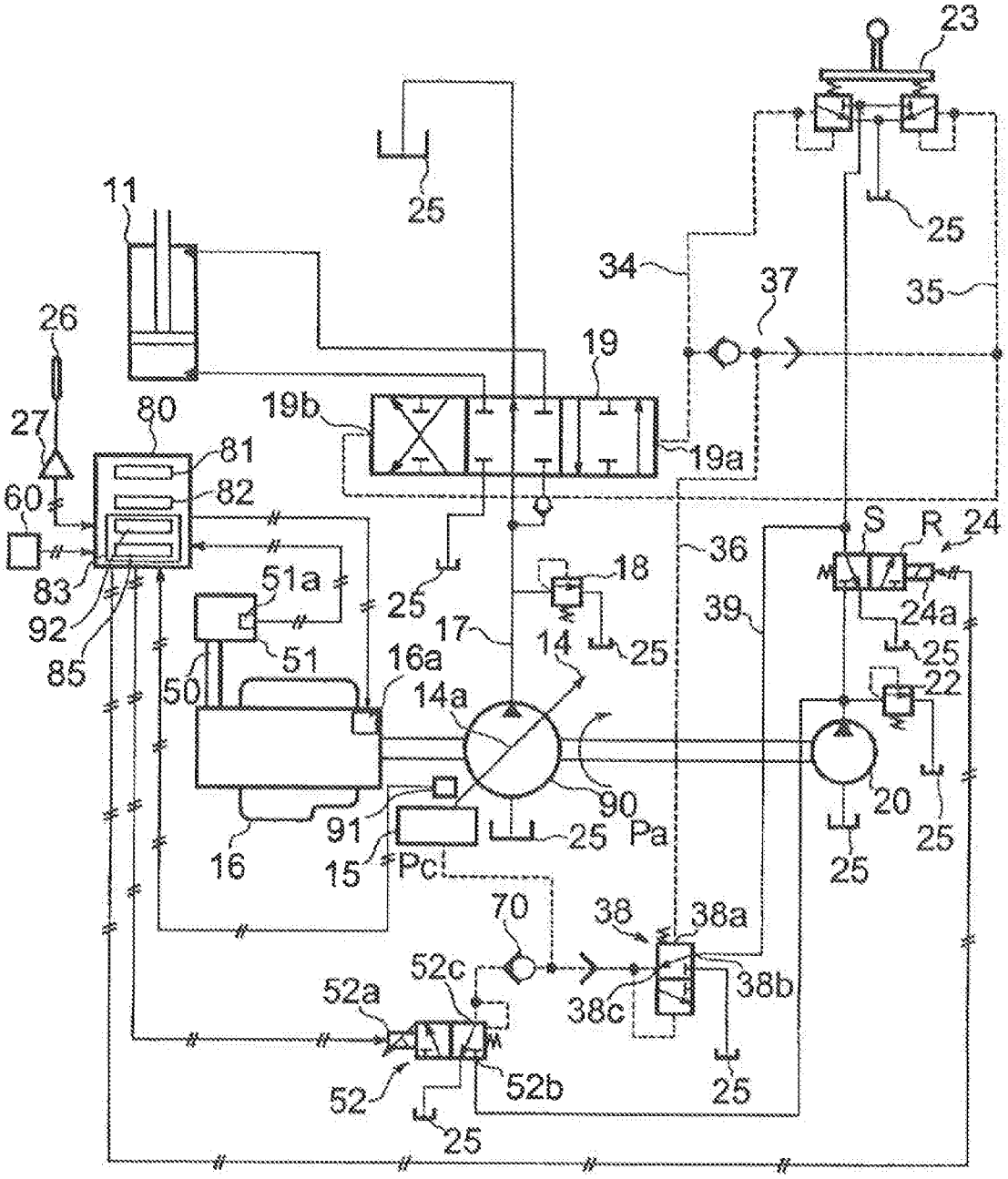
FIG. 7 is a hydraulic circuit diagram of a hydraulic drive device according to a second embodiment of the present invention.

The hydraulic drive device according to the second embodiment has a main pump 90 having the characteristic shown in FIG. 6, instead of the main pump 13 according to the first embodiment. In correspondence with the provision of the main pump 90, a tilt angle sensor 91 is provided instead of the pressure sensor 72 according to the first embodiment, and further, the engine stopping unit 83 has a discharge rate judging unit 92 instead of the control signal judging unit 84 according to the first embodiment.

The tilt angle sensor 91 detects the tilt angle of the swash plate 14*a* of the variable mechanism portion 14, and outputs a tilt angle detection signal corresponding to the detected tilt angle to the controller 80. The tilt angle sensor 91 is provided as a discharge rate detecting unit that detects the discharge rate of the main pump 90.

The discharge rate judging unit 92 judges whether or not the tilt angle detected by the tilt angle sensor 91 (discharge rate detecting unit) corresponds to a discharge rate lower than the lower limit (discharge rate Q1) on the discharge rate of the main pump 90 for use in the hydraulic excavator 1, for example, minimum discharge rate Qmin (see FIG. 6). The engine stopping unit 83 stops the engine 16 when the engine stopping unit 83 obtains a judgment result that the discharge rate Q of the main pump 90 is minimum discharge rate Qmin.

In the second embodiment configured in this way, processing in the controller 80 partially differs from that in the flowchart shown in FIG. 5. Specifically, the difference is that in step S1, the judgment by the discharge rate judging unit 92, in other words, the judgment as to whether or not the tilt angle detected by the tilt angle sensor 91 (discharge rate detecting unit) corresponds to minimum discharge rate Qmin is performed. Otherwise, the processing is the same as that shown in FIG. 5.

The hydraulic drive device according to the second embodiment provides the following advantageous effects.

In the hydraulic drive device according to the second embodiment, both regeneration control of the exhaust filter and warm-up operation for warming hydraulic oil are performed by controlling control pressure Pc to be a control pressure (Pc3, Pc4) higher than control pressure Pc1, in other words, by making discharge rate Q of the main pump 90 higher than its lower limit (discharge rate Qmin) for use in the hydraulic excavator 1. That is, the state when discharge rate Q of the main pump 90 is lower than its lower limit for use in the hydraulic excavator 1 is a state when neither regeneration control nor warm-up operation is performed, in other words, a state appropriate for stopping the engine 16. When stopping the engine 16, the engine stopping unit 83 judges, by the discharge rate judging unit 92, whether or not the discharge rate of the main pump 90 corresponding to the tilt angle detected by the tilt angle sensor 91 is minimum discharge rate Qmin, and stops the engine 16 when the engine stopping unit 83 obtains a judgment result that the discharge rate Q of the main pump 90 is minimum discharge rate Qmin. Thus, whether or not the state of the hydraulic excavator 1 is appropriate for stopping the engine 16 can be reliably judged.

It should be noted that in the hydraulic drive device according to the second embodiment described above, the discharge rate judging unit 92 makes the judgment of whether or not the discharge rate of the main pump 90 is lower than its lower limit (discharge rate Q1) for use in the hydraulic excavator 1, by using minimum discharge rate Qmin as the judgment criterion. According to an embodiment of the present invention, the discharge rate that serves as the judgment criterion is not limited to minimum discharge rate Qmin but may be a discharge rate lower than discharge rate Q1 as the lower limit but higher than minimum discharge rate Qmin. In this case, a discharge rate judging unit to be provided instead of the discharge rate judging unit 92 judges whether or not the discharge rate of the main pump 90 is equal to or lower than a predetermined discharge rate.

What is claimed is:

1. A hydraulic drive device for a construction machine, comprising:

a variable displacement hydraulic pump;

a regulator that controls a discharge rate of the variable displacement hydraulic pump;

an engine that drives the variable displacement hydraulic pump;

a control valve that controls a direction and rate of flow of pressurized oil supplied to a hydraulic actuator;

an operating lever device that is supplied with pressurized oil discharged from a pilot pump and generates a pilot pressure applied to the control valve;

a gate lock lever that is provided near a side of an operator's seat in the construction machine;

a gate lock valve that shuts off a supply line connecting the pilot pump and the operating lever device when the gate lock lever is in an open position in which the gate lock lever opens a boarding entrance;

an engine stopping unit that stops the engine when a predetermined state of the construction machine has continued for a predetermined period of time;

a discharge rate control unit that controls a discharge rate control pressure being input to the regulator, when an exhaust emission control device performs regeneration control, or performs warm-up control, and the gate lock lever is in the open position;

a control pressure detecting unit that detects a control pressure which is supplied by the discharge rate control unit to operate the regulator, or a discharge rate detecting unit that detects a discharge rate of the variable displacement hydraulic pump; wherein:

the engine stopping unit stops the engine when a pressure value of the control pressure to the regulator which is detected by the control pressure detecting unit is lower than a predetermined pressure value, or when the discharge rate of the variable displacement hydraulic pump which is detected by the discharge rate detecting unit is lower than a predetermined discharge rate.

2. The hydraulic drive device according to claim 1, wherein the predetermined discharge rate is a discharge rate lower than a lower limit for use in the construction machine.

* * * * *